US009074829B2

(12) United States Patent
Behrens et al.

(10) Patent No.: US 9,074,829 B2
(45) Date of Patent: Jul. 7, 2015

(54) LIGHTWEIGHT HIGH TEMPERATURE HEAT EXCHANGER

(75) Inventors: William W. Behrens, St. Louis, MO (US); Andrew R. Tucker, Glendale, MO (US)

(73) Assignee: The Boeing Company, Chicago, IL (US)

( * ) Notice: Subject to any disclaimer, the term of this patent is extended or adjusted under 35 U.S.C. 154(b) by 344 days.

(21) Appl. No.: 13/309,178

(22) Filed: Dec. 1, 2011

(65) Prior Publication Data

US 2013/0140003 A1 Jun. 6, 2013

(51) Int. Cl.

| | |
|---|---|
| ***F28F 13/00*** | (2006.01) |
| ***F28F 21/04*** | (2006.01) |
| *F28D 9/00* | (2006.01) |
| *F28D 21/00* | (2006.01) |

(52) U.S. Cl.

CPC ..... *F28F 13/003* (2013.01); *F28D 9/0031* (2013.01); *F28D 9/0056* (2013.01); *F28F 21/04* (2013.01); *F28D 2021/0021* (2013.01)

(58) Field of Classification Search

CPC ..... F28D 2021/0021; F28D 9/0031; F28D 9/0056; F28F 13/003; F28F 21/04

USPC ..... 165/164, 165, 166, 167, 9.1, 9.2, 9.3, 165/144, 145, 148, 153, 907, 915

See application file for complete search history.

(56) References Cited

U.S. PATENT DOCUMENTS

| | | | | |
|---|---|---|---|---|
| 3,557,557 | A | 1/1971 | Prachar | |
| 4,333,522 | A * | 6/1982 | Brune | 165/69 |
| 5,752,566 | A | 5/1998 | Liu | |
| 6,158,242 | A | 12/2000 | Lu | |
| 6,203,587 | B1 * | 3/2001 | Lesieur et al. | 48/61 |
| 6,716,782 | B2 | 4/2004 | Heng et al. | |
| 7,501,111 | B2 | 3/2009 | Keller | |
| 7,742,297 | B2 | 6/2010 | Behrens et al. | |
| 8,322,406 | B2 * | 12/2012 | Du et al. | 165/166 |
| 2004/0245389 | A1 | 12/2004 | Behrens et al. | |
| 2005/0095476 | A1 | 5/2005 | Schrooten et al. | |
| 2007/0074859 | A1 * | 4/2007 | Nakada | 165/153 |

(Continued)

FOREIGN PATENT DOCUMENTS

| | | |
|---|---|---|
| EP | 0510734 | 10/1992 |

OTHER PUBLICATIONS

European Search Report for EP12194996, dated May 3, 2013.

(Continued)

*Primary Examiner* — Ljiljana Ciric
*Assistant Examiner* — John Higgins

(57) ABSTRACT

A heat exchanger including a casing including aluminum nitride impregnated alumina-silica cloth. The heat exchanger includes a hot fluid flowpath positioned inside the casing for carrying a hot fluid from an inlet to an outlet downstream from the inlet. The hot fluid flowpath is formed at least in part by a thermally conductive wall permitting thermal energy to transfer from hot fluid flowing through the hot fluid flowpath. The heat exchanger includes a cold fluid flowpath for carrying a cold fluid from an inlet to an outlet downstream from the inlet. At least a downstream portion of the cold fluid flowpath is formed by the thermally conductive wall permitting thermal energy to transfer from hot fluid flowing through the hot fluid flowpath to the cold fluid. At least a portion of the cold fluid flowpath upstream from the thermally conductive wall is formed by ceramic foam.

15 Claims, 4 Drawing Sheets

(56) References Cited

U.S. PATENT DOCUMENTS

| | | | | |
|---|---|---|---|---|
| 2008/0000630 | A1 | 1/2008 | Haglid | |
| 2008/0196869 | A1 | 8/2008 | Behrens et al. | |
| 2008/0277104 | A1 | 11/2008 | Aoki et al. | |
| 2008/0289802 | A1 | 11/2008 | Nakajima | |
| 2009/0000328 | A1 | 1/2009 | Scherer et al. | |
| 2009/0250191 | A1* | 10/2009 | Klein | 165/44 |
| 2009/0288814 | A1* | 11/2009 | Stoia et al. | 165/185 |
| 2010/0038051 | A1* | 2/2010 | Behrens et al. | 165/41 |
| 2011/0133026 | A1 | 6/2011 | Behrens et al. | |

OTHER PUBLICATIONS

European Search Report for EP12194996, dated Feb. 13, 2015.

* cited by examiner

LIGHTWEIGHT HIGH TEMPERATURE HEAT EXCHANGER

BACKGROUND

The present disclosure generally relates to heat exchangers, and more particularly, to a lightweight heat exchanger capable of high temperature operation.

Aircraft use thermal management systems to transfer heat from air cycle system compressor outlet air to air passing through the aircraft engine fan section via heat exchangers mounted in the engine fan duct. Heat exchangers used for transferring heat from the air cycle thermal management system are frequently made from stainless steel to provide adequate heat transfer and withstand the temperature of the air cycle system compressor outlet air. Although these heat exchangers work well for their intended purpose, they are heavy, increasing fuel consumption and reducing aircraft range. Thus, there is a need for a heat exchanger that is both lightweight and able to withstand high temperatures.

SUMMARY

In one aspect, the present disclosure includes a heat exchanger for transferring thermal energy between a hot fluid and a cold fluid passing through the exchanger. The heat exchanger includes a casing. The casing comprises aluminum nitride impregnated alumina-silica cloth. The heat exchanger also includes a hot fluid flowpath positioned inside the casing for carrying a hot fluid from a hot fluid inlet to a hot fluid outlet downstream from the hot fluid inlet. The hot fluid flowpath is defined at least in part by a thermally conductive wall permitting thermal energy to transfer from hot fluid flowing through the hot fluid flowpath. The heat exchanger also includes a cold fluid flowpath for carrying a cold fluid from a cold fluid inlet to a cold fluid outlet downstream from the cold fluid inlet. At least a downstream portion of the cold fluid flowpath being defined by the thermally conductive wall permitting thermal energy to transfer from hot fluid flowing through the hot fluid flowpath to the cold fluid flowing through the cold fluid flowpath. At least a portion of the cold fluid flowpath upstream from the thermally conductive wall is defined by a ceramic foam.

In another aspect, the present disclosure includes a heat exchanger for transferring thermal energy between a hot fluid and a cold fluid passing through the exchanger. The heat exchanger comprises a thermally conductive hot fluid flowpath formed at least in part by walls comprising aluminum nitride and alumina-silica cloth for carrying hot fluid from a hot fluid inlet to a hot fluid outlet downstream from the hot fluid inlet. The heat exchanger also includes a cold fluid flowpath for carrying a cold fluid from a cold fluid inlet to a cold fluid outlet downstream from the cold fluid inlet. The cold fluid flowpath including an upstream passage formed at least in part by walls comprising aluminum nitride and alumina-silica cloth and a downstream passage formed at least in part by walls comprising aluminum nitride and alumina-silica cloth. The upstream and downstream passages are separated by a thermally conductive porous panel. Cold fluid entering the cold fluid inlet enters the upstream passage, passes through the porous panel, and enters the downstream passage.

In still another aspect, the present disclosure includes a heat exchanger for transferring thermal energy between a hot fluid and a cold fluid passing through the exchanger. The heat exchanger comprises a hot fluid flowpath formed at least in part by walls comprising aluminum nitride and alumina-silica cloth for carrying hot fluid from a hot fluid inlet to a hot fluid outlet downstream from the hot fluid inlet. The heat exchanger also includes a cold fluid flowpath formed at least in part by walls comprising aluminum nitride and alumina-silica cloth for carrying cold fluid from a cold fluid inlet to a cold fluid outlet downstream from the cold fluid inlet. The cold fluid flowpath is in thermal communication with the hot fluid flowpath for transferring thermal energy between a hot fluid and a cold fluid. The heat exchanger also includes a casing surrounding the hot fluid flowpath and the cold fluid flowpath.

Other aspects of the present disclosure will be apparent in view of the following description and claims.

BRIEF DESCRIPTION OF THE DRAWINGS

Corresponding reference characters indicate corresponding parts throughout the drawings.

DETAILED DESCRIPTION OF THE DRAWINGS

Figure 1:
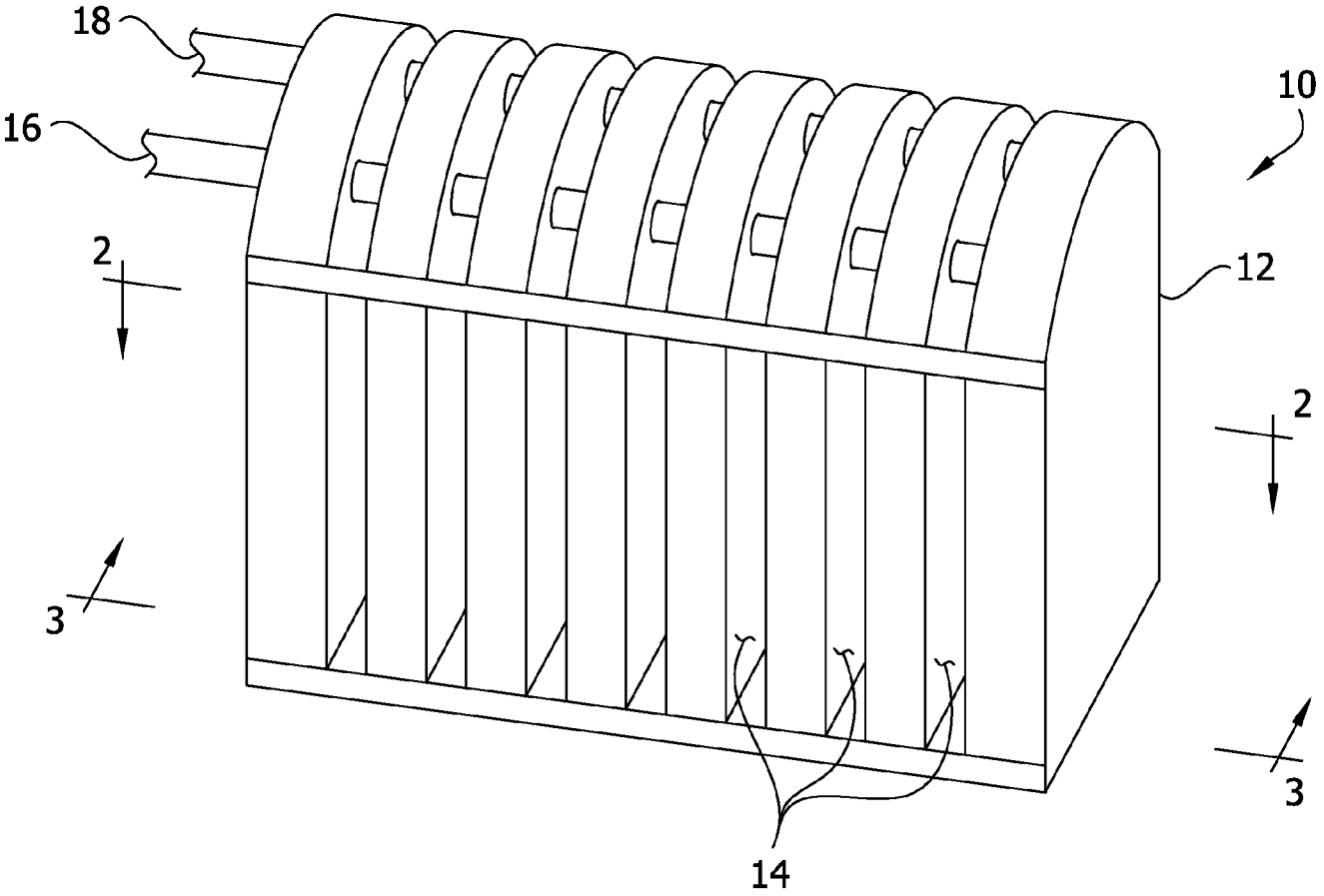
FIG. 1 is a perspective of a heat exchanger of the present embodiment.
Figure 2:
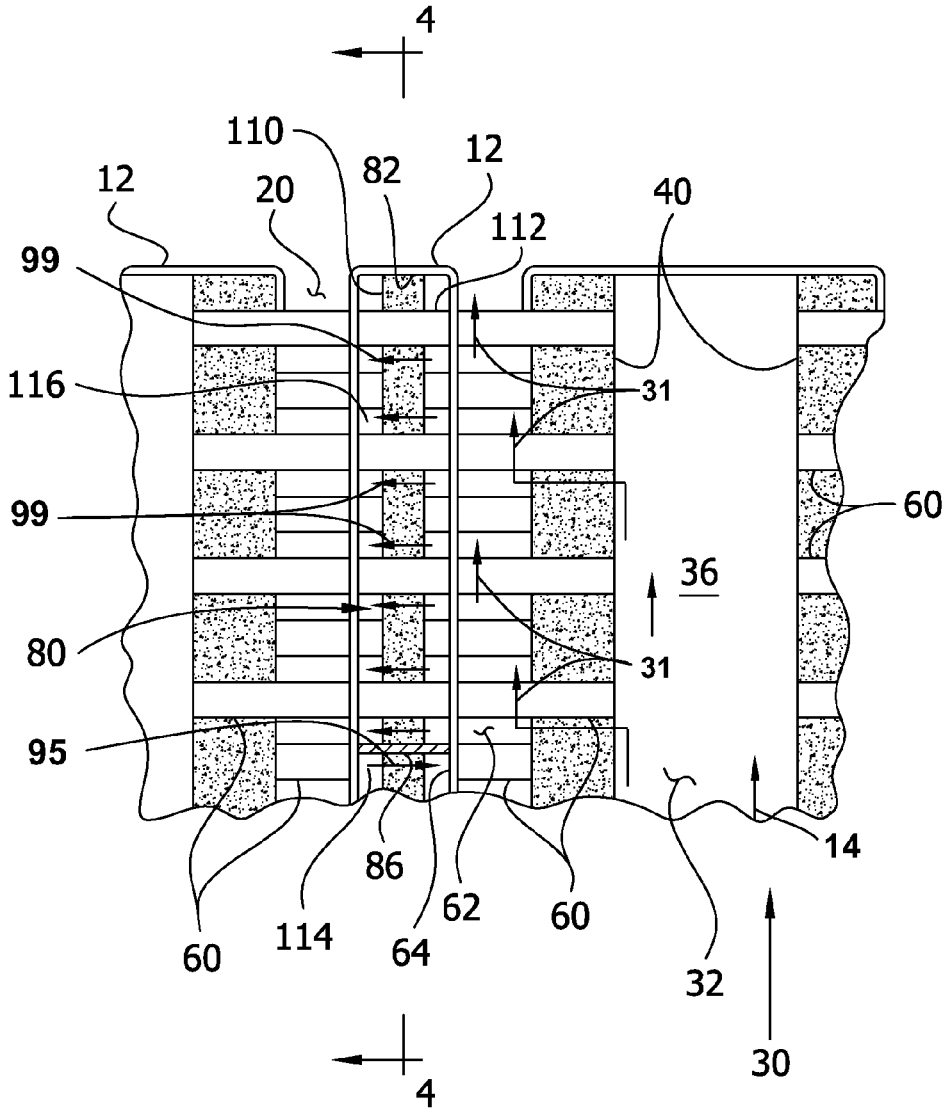
FIG. 2 is a horizontal cross section of the heat exchanger taken in the plane of line 2-2 of FIG. 1.

Referring to FIG. 1, a heat exchanger incorporating one embodiment is designated in its entirety by the reference number 10. The heat exchanger 10 has a casing 12 including a plurality of cold air inlets 14 for receiving cold fluid (e.g., cold air from a ram air duct), a hot fluid inlet 16 for receiving hot fluid (e.g., hot air from an air cycle system compressor), and a hot fluid outlet 18 for discharging the hot fluid after being cooled by the heat exchanger. The cold fluid exits the heat exchanger 10 through cold air outlets 20 (FIG. 2). In one embodiment, the casing 12 is made from aluminum nitride impregnated alumina-silica cloth but other materials may be used. This material is capable of withstanding high temperatures such as those commonly found on the outlet side of a compressor in an air cycle thermal management system on an aircraft. In one embodiment, the material is NITIVY ALF alumina-silica cloth available from Nitivy Co., Ltd. of Tokyo, Japan, or Ceramacast 675N aluminum nitride available from Aremco Products Inc. of Valley Cottage, N.Y.

Figure 3:
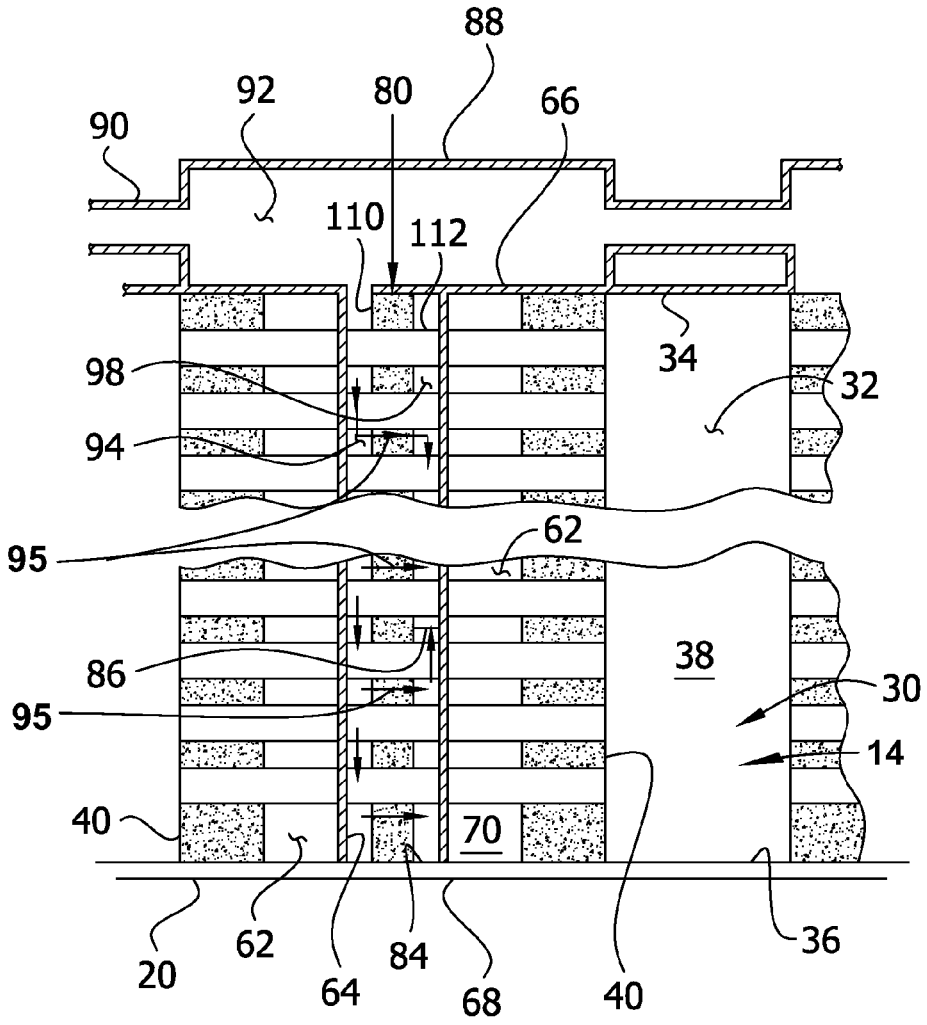
FIG. 3 is a vertical cross section of the heat exchanger taken in the plane of line 3-3 of FIG. 1.

As illustrated in FIGS. 2 and 3, cold fluid entering the heat exchanger 10 through the cold fluid inlets 14 travels along a cold fluid flowpath, generally designated by 30, to the corresponding cold fluid outlet 20. The cold fluid flowpath 30 is defined by an upstream passage 32 having a top wall 34, a bottom wall 36, an end wall 38, and opposing side walls 40. The top wall 34, bottom wall 36, and end wall 38 form at least a portion of the casing 12. The opposing side walls 40 comprise a thermally conductive ceramic foam sheet material. In one embodiment the side walls 40 comprise Boeing Rigid Insulation (BRI). BRI is a hyper-porous, micro-channel ceramic foam having a pore size of about 35 microns and over 31,350 square feet of internal surface area per cubic foot. As will be appreciated by those skilled in the art, the large internal surface area of BRI provides good convective heat transfer. Further, BRI has a thermal conductivity of about 0.05 BTU/hr-ft-° R. BRI is available from The Boeing Company of Chicago, Ill. The rigid insulation has a high surface area, providing good heat transfer to the cold fluid passing through the rigid insulation. In one embodiment the insulation has a thickness of about 0.150 inch. Boeing Rigid Insulation is described in more detail in U.S. Pat. No. 6,716,782.

Thermally conductive elements 60 extend through the ceramic foam walls 40 at spaced intervals. In one embodiment the thermally conductive elements 60 are made of aluminum nitride that is injected as a liquid into holes formed in the ceramic foam. Further, in one embodiment the elements 60 are cylindrical pins or rods having a diameter of about 0.141 inch. In one embodiment, the elements 60 are arranged in staggered rows. Although the elements may have another spacing, in one embodiment the elements in each row are vertically spaced about 0.49 inch apart and each row is spaced about 0.245 inch from adjacent rows. This element 60 size and spacing reduce the flow area through the porous side walls 40 by about twelve percent. The elements 60 span a downstream passage 62 formed between the foam side wall 40 and a thermally conductive wall 64. In one embodiment, the elements 60 are connected (e.g., with aluminum nitride) to the thermally conductive wall 64. Although the thermally conductive wall 64 may be made of other materials, in one embodiment the wall is made from alumina-silica cloth impregnated with aluminum nitride. The downstream passage 62 also includes a top wall 66, a bottom wall 68, and an end wall 70. The top wall 66, bottom wall 68, and end wall 70 form part of the casing 12.

Figure 4:
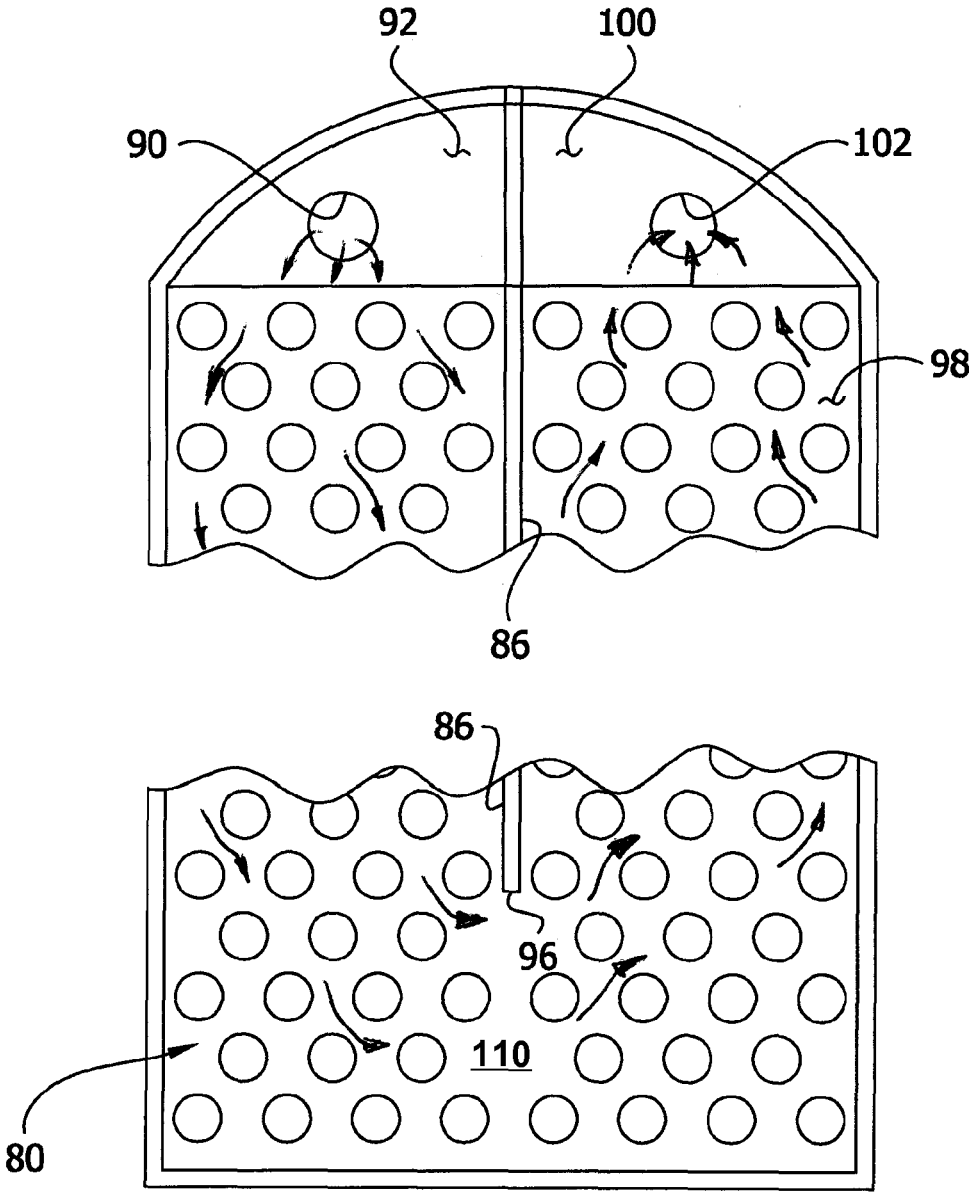
FIG. 4 is a vertical cross section of a hot fluid flowpath taken in the plane of line 4-4 of FIG. 3.

As illustrated in FIGS. 2-4, a hot fluid flowpath, generally designated by 80, is formed between opposing thermally conductive walls 64 and opposing end walls 82. A bottom wall 84 closes a lower end of the hot fluid flowpath 80. A porous foam panel 110 having spaced thermally conductive elements 112 distributed over the panel and extending through the panel and out from each face is positioned in the hot fluid flowpath 80 such that the conductive elements 112 are bonded to the opposing thermally conductive walls 64. Although the panel 110 may be made of other materials and have other thicknesses, in one embodiment the porous panel comprises BRI having a thickness of about 0.150 inch. Although the thermally conductive elements 112 may be made of other materials, in one embodiment the thermally conductive elements are made of the same material as the thermally conductive elements 60 of the cold side. Further, the thermally conductive elements 112 of one embodiment have the same diameter and spacing as the elements 60 of the cold side. Although the elements 112 may extend beyond the panel 110 by other distances, in one embodiment the elements extend about 0.125 inch from each face. A dividing wall 86 extends from a top wall 88 to the bottom wall 84 on the side of the porous panel 110 open to an upstream chamber 92 but only extends to a location above the bottom wall 84 on the opposite side of the porous panel. The dividing wall 86 divides the hot fluid flowpath 80 into an inlet side 94 and an outlet side 98.

Referring to FIGS. 1-4, hot fluid entering the hot fluid inlet 16 travels through tubing 90 to an upstream chamber 92. The hot fluid flows through an inlet 114 and downward through an upstream section 114 of the hot fluid flowpath 80. The hot fluid is nearly evenly distributed across the surface of the porous panel 110 due to the relatively high flow resistance of the panel. The hot fluid passes through the porous panel 110 alone a first hot fluid direction 95 and continues downward on the other side, eventually turning around a lower end 96 of the dividing wall 86. The hot fluid travels upward through a downstream section 98 of the hot fluid flowpath. Again, the fluid is almost evenly distributed across the surface of the porous panel 110. The hot fluid passes through the porous panel 110 again alone a second hot fluid direction 99 as it travels upward. Finally, the hot fluid travels through the downstream section 98, out an outlet 116, and into the downstream chamber 100. From the downstream chamber 100, the hot fluid travels through tubing 102 and out the hot fluid outlet 18. As the hot fluid travels through the hot fluid flowpath 90, heat is transferred to the cold flowpath by convection to the porous material and conduction from the porous material through the conductive elements 112 to the walls 64, and by direct convection to the conductive elements, then conduction to the walls 64, and finally, by direct convection to the walls 64 themselves.

Cold air entering the cold air inlet 14 travels through the upstream passage 32 generally parallel to the porous side walls 40. A majority of cold air entering the inlet 14 turns orthogonally and travels through one of the opposing porous foam side walls 40 where it absorbs thermal energy from the BRI ceramic foam. This thermal energy is conducted from the wall 64 to the ceramic foam panels 40 by the thermally conductive elements 60. The fluid becomes rarefied when forced through the BRI, decreasing fluid friction and the associated pressure drop. After exiting the porous foam side walls 40, the cold air turns orthogonally again and travels alone a first direction 31 through the downstream passage 62 generally parallel to the thermally conductive wall 64 where it absorbs more thermal energy by direct convective heat transfer from both the thermally conductive elements 60 and the conductive wall 64.

The materials used can permit operation at temperatures in excess of 1000° F. These materials are also lightweight, permitting use in aircraft. Because the materials are lightweight and the heat exchanger can withstand higher temperatures, the aircraft can have more range.

As will be appreciated by those skilled in the art, the porous side walls 40 provide large surface areas that cause air traveling through the side walls to be at a low velocity. Further, the porous side walls 40 provide a low pressure differential across the walls.

Having described the embodiments in detail, it will be apparent that modifications and variations are possible without departing from the scope defined in the appended claims.

When introducing elements of the preferred embodiment (s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods, it is intended that all matter contained in the above description and shown in the accompanying drawings shall be interpreted as illustrative and not in a limiting sense.

What is claimed is:

1. A heat exchanger for transferring thermal energy between a hot fluid and a cold fluid passing through the exchanger, said heat exchanger comprising:

a casing comprising aluminum nitride impregnated alumina-silica cloth;

a hot fluid inlet and a hot fluid outlet downstream from the hot fluid inlet;

a cold fluid inlet and a cold fluid outlet downstream from the cold fluid inlet;

a pair of thermally conductive walls;

a porous foam panel positioned in spaced, parallel relation between the thermally conductive walls and defining a gap on each side of the porous foam panel between the pair of thermally conductive walls and the porous foam panel, the pair of thermally conductive walls and the porous foam panel further defining a hot fluid flowpath inside the casing for carrying a hot fluid within each gap from the hot fluid inlet to the hot fluid outlet, each thermally conductive wall permitting thermal energy to transfer from any hot fluid flowing through the hot fluid flowpath, such hot fluid passing through the porous foam panel along a direction perpendicular to a surface of the porous foam panel on an inlet side of a dividing wall along a first hot fluid direction, and also passing through the porous foam panel along a direction perpendicular to the surface of the porous foam panel on an outlet side of the dividing wall along a second hot fluid direction opposite the first hot fluid direction; and a foam side wall positioned in spaced, parallel relation to one of the pair of thermally conductive walls and located on a side of said one of the pair of thermally conductive walls opposite the porous foam panel, said one of the pair of thermally conductive walls and the foam side wall defining at least a downstream portion of a cold fluid flowpath for carrying a cold fluid from the cold fluid inlet to the cold fluid outlet, said one of the pair of thermally conductive wall permitting thermal energy to transfer from any hot fluid flowing through the hot fluid flowpath to any cold fluid flowing through the cold fluid flowpath such that at least a portion of the cold fluid flowpath upstream from said one of the pair of thermally conductive walls being defined by the foam side wall.

2. The heat exchanger as set forth in claim 1 wherein said one of the pair of thermally conductive walls comprises aluminum nitride and alumina-silica cloth.

3. The heat exchanger as set forth in claim 1 further comprising thermally conductive elements extending from the foam side wall, through the cold fluid flowpath downstream from the foam side wall, and into thermal contact with said one of the pair of thermally conductive walls.

4. The heat exchanger as set forth in claim 3 wherein the thermally conductive elements comprise aluminum nitride pins.

5. The heat exchanger as set forth in claim 4 further comprising thermally conductive elements extending from said one of the pair of thermally conductive walls into the hot fluid flowpath.

6. The heat exchanger as set forth in claim 5 wherein the thermally conductive elements extending into the hot fluid flowpath comprise aluminum nitride pins.

7. The heat exchanger as set forth in claim 2 wherein:

the cold fluid flows past said one of the pair of thermally conductive walls in the cold fluid flowpath in a first direction after passing through the foam side wall; and the hot fluid flows past said one of the pair of thermally conductive walls in the hot fluid flowpath in a second direction extending laterally with respect to the first direction.

8. The heat exchanger as set forth in claim 7 wherein the hot fluid flowing past said one of the pair of thermally conductive walls in the hot fluid flowpath turns in a third direction generally opposite the second direction.

9. A heat exchanger for transferring thermal energy between a hot fluid and a cold fluid passing through the exchanger, said heat exchanger comprising:

a casing;

a hot fluid inlet and a hot fluid outlet downstream from the hot fluid inlet.

a cold fluid inlet and a cold fluid outlet downstream from the cold fluid inlet.

a pair of thermally conductive walls formed of aluminum nitride and alumina-silica cloth;

a porous foam panel positioned in spaced, parallel relation between the thermally conductive walls and defining a gap on each side of the porous foam panel between the pair of thermally conductive walls and the porous foam panel, the pair of thermally conductive walls and the porous foam panel further defining a hot fluid flowpath inside the casing for carrying a hot fluid within each gap from the hot fluid inlet to the hot fluid outlet, each thermally conductive wall permitting thermal energy to transfer from any hot fluid flowing through the hot fluid flowpath, such hot fluid passing through the porous foam panel along a direction perpendicular to a surface of the porous foam panel on an inlet side of a dividing wall along a first hot fluid direction, and also passing through the porous foam panel along a direction perpendicular to the surface of the porous foam panel on an outlet side of the dividing wall along a second hot fluid direction opposite the first hot fluid direction;

a foam side wall positioned in spaced, parallel relation to one of the pair of thermally conductive walls and located on a side of said one of the pair of thermally conductive walls opposite the porous foam panel, said one of the pair of thermally conductive walls and the foam side wall defining at least a downstream passage of a cold fluid flowpath for carrying a cold fluid from the cold fluid inlet to the cold fluid outlet, said one of the pair of thermally conductive wall permitting thermal energy to transfer from any hot fluid flowing through the hot fluid flowpath to any cold fluid flowing through the cold fluid flowpath such that at least a portion of the cold fluid flowpath upstream from said one of the pair of thermally conductive walls being defined by the foam side wall; and the upstream passage and the downstream passage of the cold fluid flowpath being separated by the foam side wall, the cold fluid from the cold fluid inlet entering the upstream passage, passing through the foam side wall, and entering the downstream passage.

10. The heat exchanger as set forth in claim 9 wherein the foam side wall comprises a ceramic foam.

11. The heat exchanger as set forth in claim 9 further comprising thermally conductive elements extending from the porous foam panel, through the cold fluid flowpath downstream from the porous foam panel.

12. The heat exchanger as set forth in claim 11 wherein the thermally conductive elements comprise aluminum nitride pins.

13. The heat exchanger as set forth in claim 12 further comprising thermally conductive elements extending from said one of the pair of thermally conductive walls into the hot fluid flowpath.

14. The heat exchanger as set forth in claim 13 wherein the thermally conductive elements extending into the hot fluid flowpath comprise aluminum nitride pins.

15. The heat exchanger as set forth in claim 9 wherein the casing comprises aluminum nitride impregnated alumina-silica cloth.

* * * * *